US008881896B2

(12) United States Patent
Gibson et al.

(10) Patent No.: US 8,881,896 B2
(45) Date of Patent: Nov. 11, 2014

(54) CONTAINER

(75) Inventors: Paul Gibson, Southampton (GB); Aaron McKenzie, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/131,433

(22) PCT Filed: Nov. 18, 2009

(86) PCT No.: PCT/EP2009/065417

§ 371 (c)(1), (2), (4) Date: Aug. 12, 2011

(87) PCT Pub. No.: WO2010/060845

PCT Pub. Date: Jun. 3, 2010

(65) Prior Publication Data

US 2011/0284400 A1 Nov. 24, 2011

(30) Foreign Application Priority Data

Nov. 28, 2008 (GB) ..... 0821704.4

(51) Int. Cl.

*A24F 23/00* (2006.01)
*B65D 83/08* (2006.01)
*B65D 21/08* (2006.01)

(52) U.S. Cl.

CPC ..... *B65D 83/0888* (2013.01); *A24F 23/00* (2013.01); *B65D 21/08* (2013.01); *B65D 2209/00* (2013.01)

USPC ..... 206/242; 206/236; 206/265; 206/272; 206/246; 206/264; 493/52; 215/321; 220/625

(58) Field of Classification Search

CPC .... A24F 23/00; B65D 83/0888; B65D 21/08; B65D 2209/00

USPC ..... 206/265, 272, 37, 242, 236, 246, 264, 206/526, 215; 215/321; 220/625; 493/52

See application file for complete search history.

(56) References Cited

U.S. PATENT DOCUMENTS 3,426,939 A * 2/1969 Young ..... 220/609
3,483,908 A * 12/1969 Donovan ..... 221/260
3,910,444 A * 10/1975 Foster ..... 215/295

(Continued)

FOREIGN PATENT DOCUMENTS

CL 210-96 10/1996
CL 1211-11 1/2012

(Continued)

OTHER PUBLICATIONS

International Search Report and Written Opinion, mailed Jan. 28, 2010 for PCT/EP2009/065417, filed Nov. 18, 2009.

(Continued)

*Primary Examiner* — Anthony Stashick
*Assistant Examiner* — James M Van Buskirk
(74) *Attorney, Agent, or Firm* — NW Poulsen

(57) ABSTRACT

A container for holding unused and used snus is disclosed. The container comprises a base defining a first compartment to receive unused snus. The base has a bottom wall which is reconfigurable to form a second compartment for holding used snus on the other side of said bottom wall. The first and second compartments are each provided with a separate cover.

14 Claims, 3 Drawing Sheets

(56) References Cited

U.S. PATENT DOCUMENTS

| | | | | | |
|---|---|---|---|---|---|
| 4,098,421 | A | * | 7/1978 | Foster | 215/321 |
| 4,770,318 | A | * | 9/1988 | Earl | 220/785 |
| 5,791,473 | A | * | 8/1998 | Decker et al. | 206/407 |
| D515,439 | S | * | 2/2006 | Pace | D9/746 |
| 2005/0175741 | A1 | * | 8/2005 | Reinders | 426/106 |
| 2007/0228051 | A1 | | 10/2007 | Meroni | |
| 2009/0014450 | A1 | * | 1/2009 | Bjorkholm | 220/521 |

FOREIGN PATENT DOCUMENTS

| | | | | |
|---|---|---|---|---|
| EP | 1667541 | | | 6/2006 |
| JP | 6-45496 | U | | 6/1994 |
| WO | WO03074385 | A1 | | 9/2003 |
| WO | WO 2008066450 | A1 | * | 6/2008 |
| WO | WO2008066450 | A1 | | 6/2008 |
| WO | 2010/060723 | A1 | | 6/2010 |

OTHER PUBLICATIONS

International Preliminary Report on Patentability, mailed Jun. 9, 2011, for PCT/EP2009/065417, filed Nov. 18, 2009.

International Search Report and Written Opinion corresponding to PCT/EP2009/065417 mailed Jan. 28, 2010.

* cited by examiner

CONTAINER

CLAIM FOR PRIORITY

This application is a National Stage Entry entitled to and hereby claims priority under 35 U.S.C. §§365 and 371 to corresponding PCT Application No. PCT/EP2009/065417, filed Nov. 18, 2009, which in turn claims priority to British Application Serial No. GB 0821704.4, filed Nov. 28, 2008. The entire contents of the aforementioned applications are herein expressly incorporated by reference.

The present invention relates to a container for snus.

Snus may be sold either in loose form or in portions disposed in permeable bags and it is packaged in boxes having a resealable lid so to maintain the snus moist. Snus is typically consumed by placing it under the upper lip for an extended period of time, thereafter it should preferably be disposed of in a suitable place such as a bin or the like to avoid littering. However, littering of snus is a common problem as, unlike cigarette smoking, consumption of snus is not restricted to a designated area and so a user may not always be in the vicinity of a bin when he/she needs to discard used snus.

To overcome the above mentioned problem, it is known from EP 1667541 B to provide a container holding unused snus, wherein the container also comprises a separate compartment for temporarily receiving consumed snus. The compartment is defined by a recess in the lid and a cover which is connected to the lid with a hinge allowing for the cover to be repeatedly opened and closed. Owing to the design, some used snus can be accumulated in the separate compartment until the user has access to an appropriate bin. However, one of the disadvantages of this container is that it does not utilise its full volume at any given time. For example, the container is either packaged with less unused snus than a standard container of similar dimensions due to the incorporated second compartment imposing on the space for holding unused snus or, the container must be larger than normal so as to provide an empty separate compartment for receiving used snus.

It is also known from WO 2008/066450 to provide a container for snuff having a dividing wall which divides the interior of the container so that one compartment holds unused snuff and the second compartment receives and stores used snuff. The dividing wall comprises two walls which are movable relative to each other so that the volumes of the two compartments are adjustable to the amount of unused and used snuff present in the container. However, as the lid to the container provides access to both the used and unused snuff the user may experience an unpleasant odour and/or sight as he/she retrieves a portion of snuff.

The present invention seeks to provide a container for snus that overcomes or substantially alleviates the problems mentioned above.

According to the present invention, there is provided a container comprising a base and a lid defining a first compartment therebetween for storing unused snus and in which at least the lid or the base includes a reconfigurable wall to enable a user to form or enlarge a second compartment on the other side of said wall to the first compartment for storing used snus, and a cover for closing the second compartment.

Preferably, the wall is at least partially formed from a resilient material positionable in a selectable one of a plurality of stable positions, the wall being movable into one of said positions in response to the application of pressure thereto by deforming it beyond a predetermined point, the wall being biased in a direction towards its existing position prior to reaching said predetermined point and being biased in a direction towards another position once it has been deformed beyond said predetermined point.

In one embodiment, the wall is at least partially formed from a resilient material, enabling the wall to gradually deform such that it can assume any position between two extreme positions.

Preferably, the wall comprises a central portion surrounded by an annular region configured such that the wall deforms in said region in response to the application of pressure to said central portion so that the central portion moves into the first compartment towards a second configuration.

Conveniently, said region comprises an annular groove, the central portion folding about the groove as it moves towards its second configuration.

Preferably, the annular groove is formed from resilient material configured so that the central portion will assume its second configuration when a predetermined pressure has been applied to the central portion.

The cover may lie directly against the wall in a first configuration such that a second compartment is formed only when the wall is reconfigured.

In one embodiment, the central portion is slightly recessed below an outer surface of the wall in its first configuration such that the cover and the wall lie flush when the cover is received in the recess and attached to the wall.

Preferably, the container is formed with first and second compartments that together define a total volume of the container, the wall being configured so as to enable the relative volume of the first and second compartments to be varied without altering said total volume.

The container may be formed with only a first compartment that defines total volume of the container, the wall being formed so as to enable a portion of the volume of the first compartment to form the second compartment without altering said total volume, when said wall is reconfigured.

Conveniently, the wall comprises an annular recess on the outside of the groove to receive a cooperating protrusion on the cover to attach the cover to the wall.

Preferably, the cover comprises a cooperating protrusion that extends in a radial direction and locates in the annular recess in the wall.

The cover may include a second protrusion that extends in an axial direction, said second protrusion locating in said annular groove to attach the cover to the wall.

In one embodiment, the central region is a rigid plate that does not deform when the wall is reconfigured.

The present invention also provides a method of forming a disposal compartment in a container for snus, the container having a base and a lid defining a first storage compartment therebetween to receive unused snus, in which at least the base and/or the lid includes a wall and a cover, the method comprising the steps of removing the cover from the wall and applying pressure to said wall to reconfigure the wall so as to form a second compartment for storing used snus on the other side of said wall to said first storage compartment.

Embodiments of the present invention will now be described by way of example only, with reference to the accompanying drawings, in which.

Figure 1:
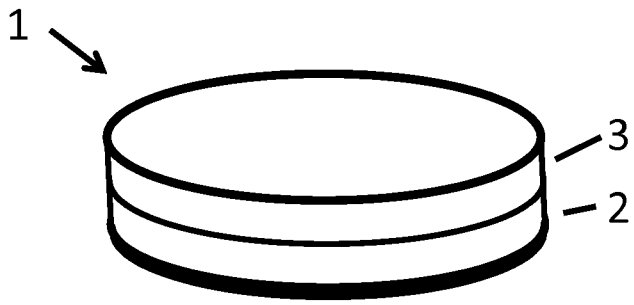
FIG. 1 shows a perspective view of a snus container according to the present invention.
Figure 2:
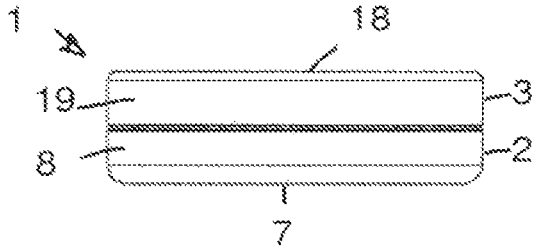
FIG. 2 shows a side view of the snus container of FIG. 1.
Figure 6:
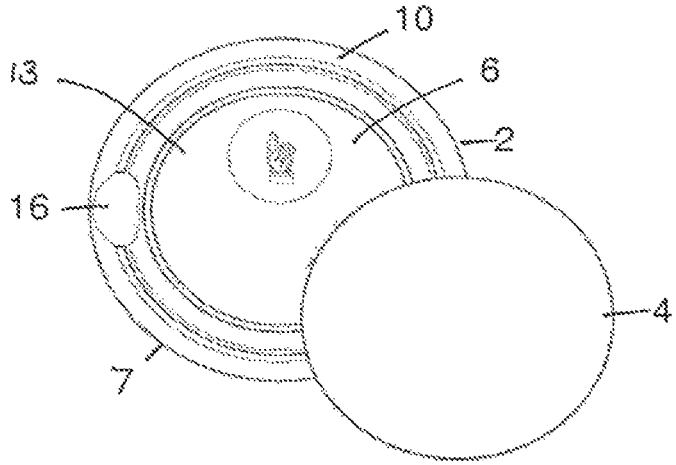
FIG. 6 shows another bottom view of the base of FIGS. 1 and 2 having the cover partially removed.

Referring now to the drawings, there is shown in FIGS. 1 and 6 a container 1 comprising a base 2, lid 3 and a cover 4. The base 2 and the lid 3 define a first space or compartment 5 for storing fresh or unused snus, and the base 2 and the cover 4 define a second space or disposal compartment 6 for holding consumed or used snus, at least in one configuration, as will be explained below.

Figure 5:
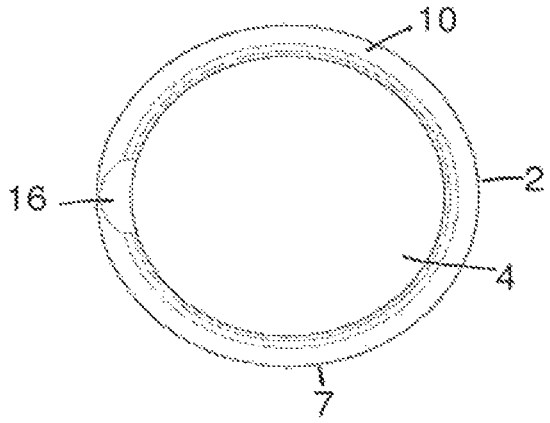
FIG. 5 shows a bottom view of the base of FIGS. 1 and 2 having a cover.

The base 2 comprises a circular bottom wall 7 having a peripheral wall 8 extending upwards whereof a top portion 9 is of a smaller diameter allowing it to receive the lid 3. The bottom wall 7 of the base 2 includes an outer portion 10 enclosing a central portion 13, an annular region having an outer annular recess 11 and an inner annular groove 12. The annular recess 11 and groove 12 engage with two annular protrusions 14, 15 of the cover 4 so that the cover 4 is releasably attachable to the bottom wall 7 of the base and produces an outer flush finish. The outer portion 10 is provided with a recess 16, as seen in FIGS. 5 and 6, enabling the user to remove the cover 4 by using their fingers and so accessing the central portion 13 providing the disposal compartment 6.

Figure 3:
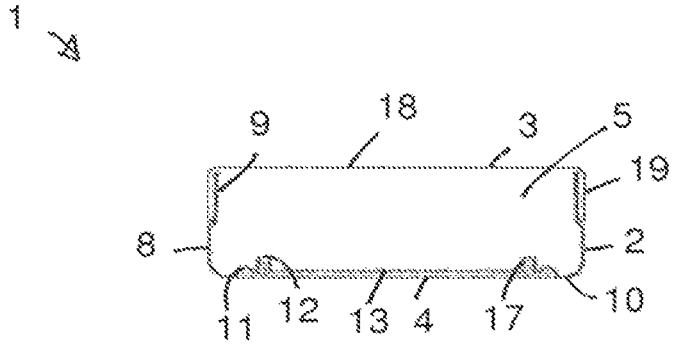
FIG. 3 shows a cross-sectional view of the snus container of FIGS. 1 and 2 having an inner bottom portion projecting outwardly.
Figure 4:
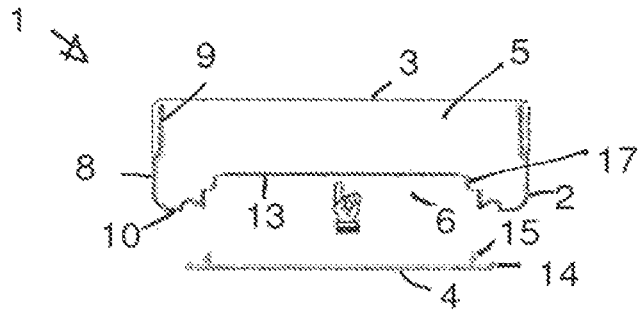
FIG. 4 shows another cross-sectional view of the snus container of FIGS. 1 and 2 having the inner bottom portion projecting inwardly.

The central portion 13 is surrounded by the annular recess 11 and groove 12 as illustrated in FIGS. 3 and 4 wherein the groove 12 permits the central portion 13 to assume a first and second configuration. FIG. 3 illustrates the first configuration wherein the central portion 13 projects outwardly and the annular recess 11 and groove 12 receive the two annular protrusions 14, 15 of the cover 4. In this configuration, the container 1 does not provide a disposal compartment 6 as the cover 4 and the central portion 13 are closely aligned and the cover 4 lies against the central portion 13. As can be appreciated from FIG. 3, the central portion 13 is only slightly recessed below the outer portion 10 of the base so as to provide a space to receive the cover 4 so that the outer surface of the cover 4 is essentially flush with the outer portion 10 of the base to provide a smooth outer surface or join between the cover 4 and the outer portion 10. Although it is preferable that there is no second or used snus compartment in the first configuration, it will be appreciated that there could also be a space between the central portion 13 and the cover 4.

The groove 12 is formed out of a flexible resilient material such as plastic so that it will deform so as to allow the central portion 13 to assume its second configuration in which the central portion 13 projects inwardly and so produces the disposal compartment 6 as seen in FIG. 4. This is achieved by pushing the reconfigurable portion 13 towards space 5 so that the inner peripheral wall 17 of the groove 12 folds back over itself until it extends in the opposite direction. As the volume of the container 1 is defined to the outer boundaries of the base 2, lid 3 and cover 4, reconfiguration of the container 1 results in a redistribution of the space such that the volume of the space 5 holding unused snus is reduced whereas the volume of the space 6 receiving consumed snus is increased. This feature accommodates for temporarily storing discarded snus without initially imposing on the space provided for the packaging of unused snus and so the dimensions of the container remains similar to those containers without a disposal compartment.

It is envisaged that the central portion 13 will move between its first and second positions as a result of deformation of the groove 12 with a snapping action, i.e. the resilience of the groove 12 will cause the central portion 13 to "snap" or "pop" into its second configuration when the pressure applied to the central portion 13 is sufficient to cause it to move beyond a certain limit point before its second configuration is reached. Beyond this limit point, no further pressure is required for it to assume its second configuration. If, however, insufficient pressure is applied to the central portion 13 so that the limit point is not reached, the resilience of the central portion 13 will cause it to regain its original configuration when released.

The lid 3 comprises a circular top 18 from which a peripheral side wall 19 depends. The side wall 19 of the lid 3 is of similar length as the top portion 9 of the wall of the base 2 so that when the container 1 is closed the top portion 9 of the wall of the base 2 is surrounded by the peripheral side wall 19 of the lid 3.

Operation of the present invention will now be described in reference to FIGS. 3 and 4. The user removes the lid 3 from the base 2 to access the unused snus, retrieves a portion of snus and places it under his/her lip. In the event that the user is to discard the used snus and there is no convenient bin or the like the user removes the cover 4 from the base 2 and pushes the central portion 13 inwards so to provide a space 6 for the discarded snus. The cover 4 is then re-attached to the base 2 so that the used snus is temporarily stored.

In an alternative un-illustrated embodiment of the present invention, a top wall of a lid may assume a first and second configuration instead of the base as previously described. In this alternative embodiment the lid and base define a first space for fresh snus and a cover which is releasably attachable to the lid define a second space or disposal compartment for used snus. Briefly, the lid comprises a central portion surrounded by an annular region having an outer annular recess and an inner annular groove. The inner annular groove enables the top wall of the lid to deform so as to allow the central portion to assume its second configuration in which the central portion projects inwardly into the first space and so produces the disposal compartment. The outer annular recess receives protrusions of the cover so that the disposal compartment can be temporarily sealed.

It should be realised that the space 6 defined by the cover 4 and the central portion 13 may already be of a significant volume when the reconfigurable portion projects outwardly so that the space can hold the first few discarded snus portions. As more snus is consumed and the space holding the discarded snus becomes full, the central portion 13 can be pushed inwardly into the relatively empty space 5 so to provide more space for the discarded snus.

It will be appreciated that further resilient grooves can be implemented in the annular region surrounding the central portion so that the space holding the used snus can gradually be enlarged or expanded as more snus is consumed and more space in the disposal compartment is required. Therefore, the relative sizes of the compartments can be altered in stages by applying pressure to the central region to deform each annular groove in turn by a predetermined amount. The wall may snap into each position when pressure is applied so that the user knows that a new predefined position has been reached.

It is envisaged that the component of the container comprising the reconfigurable features is made from injection moulded polypropylene and the corresponding component defining the first space holding fresh snus is formed from pressed metal.

In an alternative embodiment, the wall may just stop deforming once pressure applied to it is released and so the size of the compartment may be determined by the user rather than having a number of predetermined stages. It is envisaged that the annular region would then be made from a material which enables the annular groove to be gradually deformed such that the central portion is not limited to defined positions by a snapping action. In this alternative embodiment, the deformed annular groove remains in its position due to resistance of the material and to further enlarge a space additional pressure is required to continue deforming the annular groove until no further deformation is possible.

In a further modification, both the lid and the base may be provided with a reconfigurable wall and the user may then have the option of whether to form a used snus compartment in the lid, the base or even in both the lid and the base.

Furthermore, it should be realised that the container may comprise a plurality of compartments in which an additional compartment can be formed, or an existing compartment enlarged, by applying pressure to a reconfigurable portion of a wall forming the container.

Although reference is primarily made to the formation or enlargement of a disposal compartment which may gradually be increased in size as snus is consumed at the expense of the size of the unused snus compartment, it may also be possible for the user to make the disposal compartment smaller once again. This may be required if, for example, the container is to be re-used.

It will be appreciated from the foregoing, that the present invention provides a container that initially has a compartment whose volume can be reduced by the formation of another compartment by reconfiguring the outer wall of the compartment so that it extends into the original volume of the initial compartment. In another embodiment, the container may already have two or more compartments and a deformable wall that separates two compartments may be reconfigured in response to the application of pressure by a user, so as to change the volume of each compartment relative to each other as snus is consumed and more space is required to store used snus.

Although embodiments of the invention have been shown and described, it will be appreciated by those persons skilled in the art that the foregoing description should be regarded as a description of preferred embodiments only and that other embodiments that fall within the scope of the appended claims are considered to form part of this disclosure.

The invention claimed is:

1. A container comprising:

a base and a lid defining an unused snus first storage compartment therebetween, the base comprising a bottom wall and a peripheral side wall and the lid comprising a top wall and a peripheral side wall, wherein at least one of the top wall of the lid and the bottom wall of the base is a reconfigurable wall to enable a user to form and enlarge a used snus second storage compartment on the side of said reconfigurable wall that is opposite the unused snus first storage compartment, the reconfigurable wall at least partially formed from a resilient material and positionable in a selectable one of a plurality of stable positions, the reconfigurable wall being movable into one of said plurality of stable positions in response to application of pressure thereto by deforming it beyond a predetermined point; and a cover for closing the used snus second storage compartment;

wherein a central portion of the reconfigurable wall is slightly recessed with respect to an outer surface of the reconfigurable wall in a first configuration such that the cover and the reconfigurable wall lie flush when the cover is received in the recess and attached to the reconfigurable wall, and the used snus second storage compartment is formed only when the reconfigurable wall is reconfigured.

2. The container according to claim 1, the reconfigurable wall being biased in a direction towards its existing position prior to reaching said predetermined point and being biased in a direction towards another position once it has been deformed beyond said predetermined point.

3. The container according to claim 1, wherein the reconfigurable wall is at least partially formed from a resilient material, enabling the reconfigurable wall to gradually deform such that the reconfigurable wall is capable of assuming any position between two extreme positions.

4. The container according to claim 1, wherein the reconfigurable wall comprises a central portion surrounded by an annular region configured such that the reconfigurable wall deforms in said annular region in response to application of pressure to said central portion so that the central portion moves into the unused snus first storage compartment towards a second configuration.

5. The container according to claim 4, wherein said annular region comprises an annular groove, the central portion folding about the annular groove as it moves towards the second configuration.

6. The container according to claim 5, wherein the annular groove is formed from resilient material configured so that the central portion will assume the second configuration when a predetermined pressure has been applied to the central portion.

7. The container according to claim 1, wherein the container is formed with the unused snus first storage compartment and the used snus second storage compartment that together define a total volume of the container, the reconfigurable wall being configured to enable the relative volume of the unused snus first storage compartment and the used snus second storage compartment to be varied without altering said total volume.

8. The container according to claim 1, wherein the container is formed with only the unused snus first storage compartment that defines a total volume of the container, the relative volumes of the unused snus first storage compartment and the used snus second storage compartment varying according to the positioning of the reconfigurable wall, without altering said total volume.

9. The container according to claim 1, wherein the reconfigurable wall comprises an annular recess, on the outside of an annular groove, configured to receive a cooperating protrusion on the cover to attach the cover to the reconfigurable wall.

10. The container according to claim 9, wherein a cooperating protrusion extends in a radial direction and locates in the annular recess in the reconfigurable wall.

11. The container according to claim 10, wherein the cover includes a second protrusion that extends in an axial direction, said second protrusion locating in said annular groove to attach the cover to the reconfigurable wall.

12. The container according to claim 4, wherein the central region is a rigid plate that does not deform when the reconfigurable wall is reconfigured.

13. A method of forming a disposal compartment in a snus container, the container having a base and a lid defining an unused snus first storage compartment therebetween, in which at least one of the base and the lid includes a wall and a cover, the method comprising:

removing the cover from the wall; and applying pressure to said wall to reconfigure the wall so as to position said wall into a selectable one of a plurality of stable positions, thereby at least one of forming and enlarging a used snus second storage compartment on the side of said wall that is opposite to said unused snus first storage compartment.

14. A container comprising:

a base and a lid defining an unused snus first storage compartment therebetween, the base comprising a bottom wall and a peripheral side wall and the lid comprising a top wall and a peripheral side wall, wherein at least one of the top wall of the lid and the bottom wall of the base is a reconfigurable wall to enable a user to at least one of form and enlarge a used snus second storage compartment on the side of said reconfigurable wall that is opposite the unused snus first storage compartment the reconfigurable wall comprising an annular recess, on the outside of an annular groove, configured to receive a cooperating protrusion on the cover to attach the cover to the reconfigurable wall; and a cover for closing the used snus second storage compartment, including the cooperating protrusion, said cooperating protrusion extending therefrom in a radial direction and locating in the annular recess in the reconfigurable wall.

* * * * *